US006012377A

United States Patent [19]

Hung

[11] Patent Number: 6,012,377

[45] Date of Patent: Jan. 11, 2000

[54] SHUTTLE VALVE OF A RECIPROCATING PNEUMATIC MOTOR FOR HYDRAULICS

[76] Inventor: Michael Hung, 9-16, Nan Kan Hsia, Nan Kan, Lu Chu Hsiang, Tao Yuan, Taiwan

[21] Appl. No.: 09/023,794

[22] Filed: Feb. 13, 1998

[51] Int. Cl.[7] ..... F01L 21/04; F01L 25/04

[52] U.S. Cl. ..... 91/229; 91/224; 91/225

[58] Field of Search ..... 92/224, 225, 227, 92/229; 251/80

[56] References Cited

U.S. PATENT DOCUMENTS

| | | | |
|---|---|---|---|
| 1,642,074 | 9/1927 | Lewis | 91/229 |
| 3,233,426 | 2/1966 | Cowans | 91/224 |
| 3,354,787 | 11/1967 | Takahata | 91/222 |
| 3,597,121 | 8/1971 | McClocklin | 91/227 |
| 4,352,644 | 10/1982 | Landrum et al. | 91/224 |
| 5,341,723 | 8/1994 | Hung | 91/224 |

*Primary Examiner*—F. Daniel Lopez
*Attorney, Agent, or Firm*—Wenderoth, Lind & Ponack, L.L.P.

[57] ABSTRACT

A shuttle valve mounted between a pneumatic piston and a ring plate in a reciprocating pneumatic motor and moved to control the passage between a shuttle compression chamber and a radial air inlet hole in the pneumatic piston, the shuttle valve having a press rod supported on a compression spring and forced out of the front end of the body of the shuttle valve for pressing against the cylinder cover of the reciprocating pneumatic motor, enabling the shuttle valve to shut off automatically at an early stage so as to extend the piston stroke when the pneumatic piston bears the load, or to shorten the piston stroke when the pneumatic piston bears no load.

1 Claim, 6 Drawing Sheets

SHUTTLE VALVE OF A RECIPROCATING PNEUMATIC MOTOR FOR HYDRAULICS

BACKGROUND OF THE INVENTION

1. Field of the Invention

The present invention relates to a shuttle valve for a reciprocating pneumatic motor for hydraulics, and more particularly to such a shuttle valve which has a press rod supported on a compression spring in it that causes the pneumatic piston to change its stroke subject to the condition of the load.

2. Description of the Prior Art

U.S. Pat. No. 5,341,723 which is issued to the present inventor discloses a reciprocating pneumatic motor for hydraulics which has a pair of guide grooves on the inner wall of a cylinder provided, together with a pneumatic piston and a shuttle valve to function pneumatically. The piston has a seal ring which passes the guide grooves to allow air to flow into the shuttle compression chamber, pushing the shuttle valve and opening up a channel for the venting of air. The piston is integrated with a ring plate using plastic ultrasound technology which simplifies the structure of the pneumatic motor. This structure of reciprocating pneumatic motor is functional. However, because the stroke of the pneumatic piston maintains unchanged when bearing no load, the working efficiency of the reciprocating pneumatic motor is slightly low.

SUMMARY OF THE INVENTION

The present invention improves the structure of the shuttle valve indicated in U.S. Pat. No. 5,341,723. The shuttle valve has a press rod and a compression spring mounted in a longitudinal center through hole in the valve body thereof. The press rod is forced out of the front end of the body of the shuttle valve by the compression spring to press against the cylinder cover of the reciprocating pneumatic motor, enabling the shuttle valve to shut off automatically at an early stage so as to extend the piston stroke when the pneumatic piston bears the load, or to shorten the piston stroke when the pneumatic piston bears no load.

DETAILED DESCRIPTION OF THE PREFERRED EMBODIMENT

Figure 1:
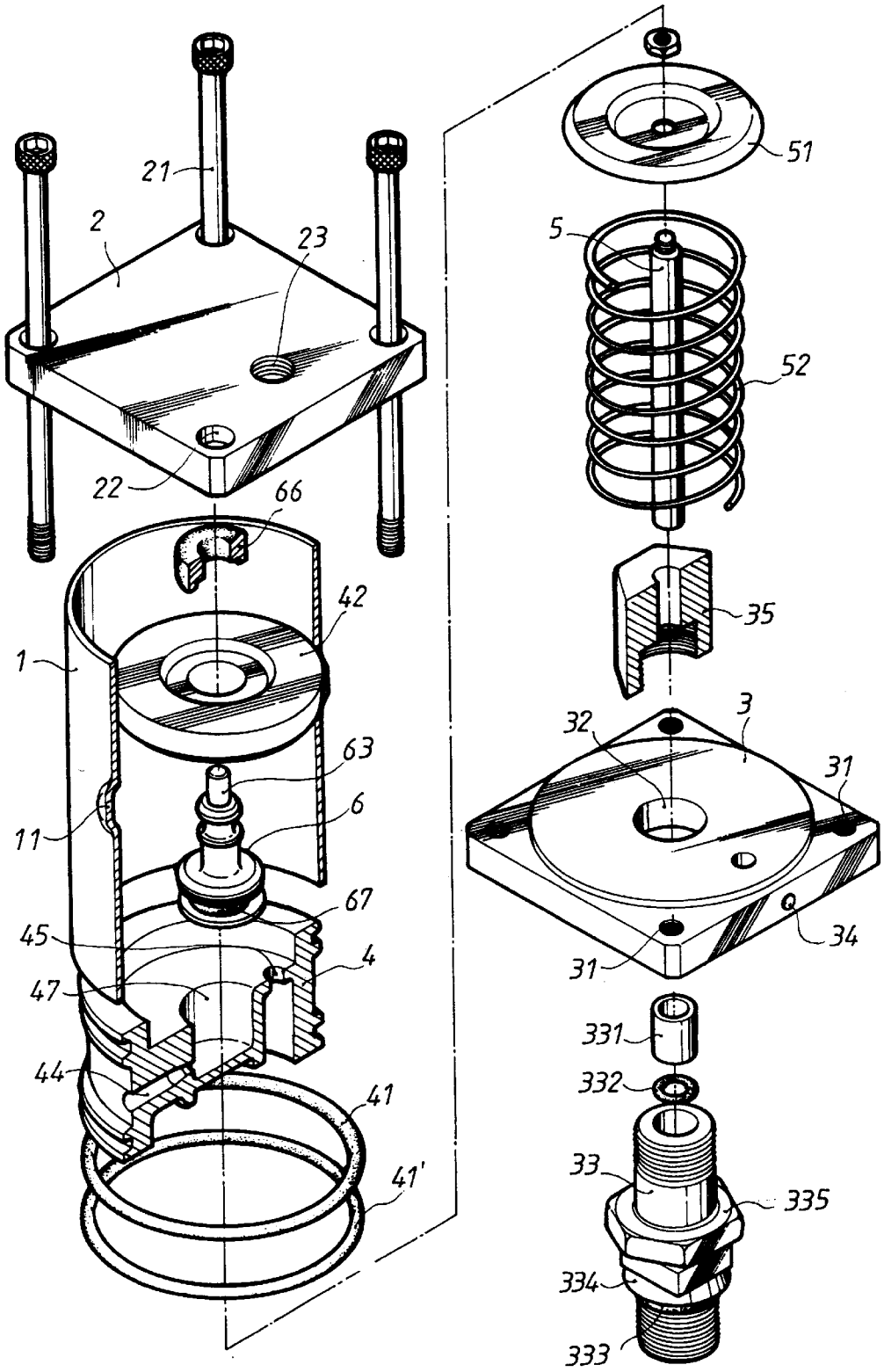
FIG. 1 is an exploded view of a reciprocating pneumatic motor constructed according to the present invention.
Figure 2:
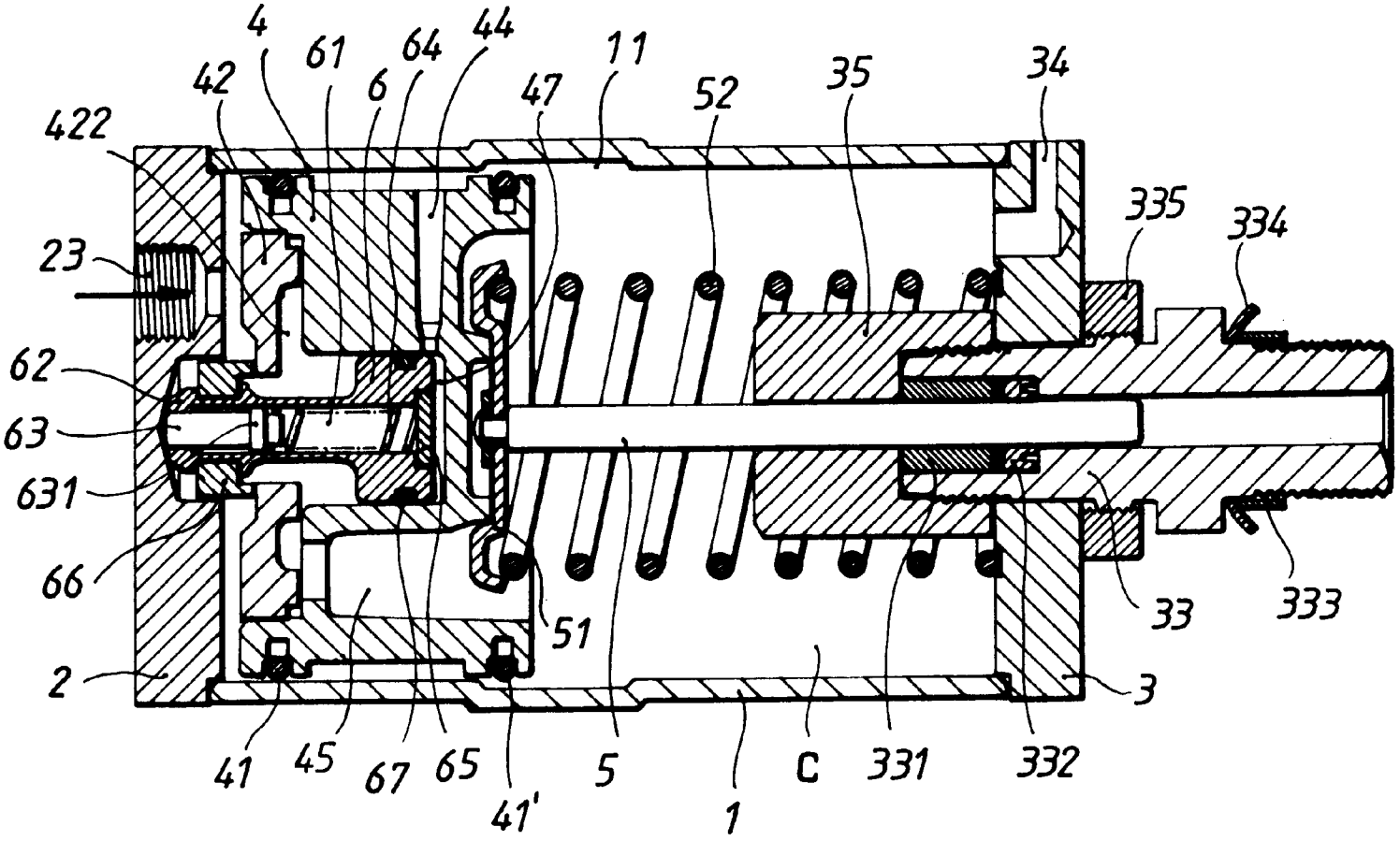
FIG. 2 is a cross-sectional view of the motor in a stage before compression according to the present invention.

Referring to FIGS. 1 and 2, a reciprocating pneumatic motor is shown comprised of a cylinder 1 having a pneumatic piston 4 and a piston rod 5 therein, a cylinder cover 2 and a bottom cover 3. The cylinder 1 has the cylinder cover 2 on its top and the bottom cover 3 on its bottom, said covers are preferably joined one at each end of cylinder, using hex bolts 21. At a selected location in the cylinder body is a pair of corresponding guide grooves 11 which protrude from the exterior wall. The guide grooves 11 are punched directly during fabrication and do not require additional machining or grinding. The cylinder cover 2 has bolt holes 22 in the four corners thereof for the hex bolts 21 to extend through and an air inlet hole 23 is opened at a selected location on the cylinder cover 2. The bottom cover 3 also has bolt holes 31 in the four corners thereof for the hex bolts 21 to be screwed in. The center of the bottom cover 3 has a central hole 32 for a piston pump 33 to extend through. The surface and the edge of the bottom cover 3 have a plurality of L-shaped holes 34. The inside diameter of an upper portion of the piston pump 33 has a liner 331 and an O-ring 332 which extend through the bottom cover 3 and lock onto a piston pump cover 35. The lower portion of the piston pump 33 has an oil seal 333, a washer 334 and a hex nut 335. The pneumatic piston 4 is a circular body having a first seal ring 41 on its top and a second seal ring 41' on its bottom. The circular body of the pneumatic piston 4 has an indented surface on which a ring plate 42 is joined with an appropriate gap 422, as shown in FIG. 2. The central part of the indented surface of the circular piston body has a central slotted hole (not shown) from which a radial air inlet hole 44 is connected. The indented surface has an air vent hole 45 which is located closely to the central slotted hole (not shown). A shuttle compression chamber 47 is formed at the indented surface of the circular body of the pneumatic piston 4. A shuttle valve 6 is mounted between the pneumatic piston 4 and the ring plate 42, and moved to control the passage between the front air chamber A and an air vent hole 45. The piston rod 5 has one end extending through the piston pump cover 35 into the piston pump 33 and the other end is locked onto a spring base 51 from which a coiled spring 52 is attached. The spring base 51 is snug to the bottom of the pneumatic piston 4. The stretching of the coiled spring 52 enables the reciprocating movement of the piston rod 5.

The body of the shuttle valve 6 has a longitudinal center through hole 61 through its longitudinal central axis, and an inside annular flange 62 at the front end of the longitudinal center through hole 61. The rear end of the longitudinal center through hole 61 is covered with an end cap 65. A compression spring 64 is mounted inside the longitudinal center through hole 61 and supported on the end cap 65. A press rod 63 is supported on the compression spring 64 inside the longitudinal center through hole 61, having a front end extending out of the inside annular flange 62 and an outward flange 631 raised around a rear end thereof and supported on the compression spring 64. The compression spring 64 imparts an outward pressure to the press rod 63, causing it to extend out of the front end of the body of the shuttle valve 6. The inside annular flange 62 of the body of the shuttle valve 6 stops the outward flange 631 of the press rod 63 from passing through. Further, a gasket ring 66 and an oil seal ring 67 are mounted around the outside wall of the body of the shuttle valve 6 near its two opposite ends.

Figure 3:
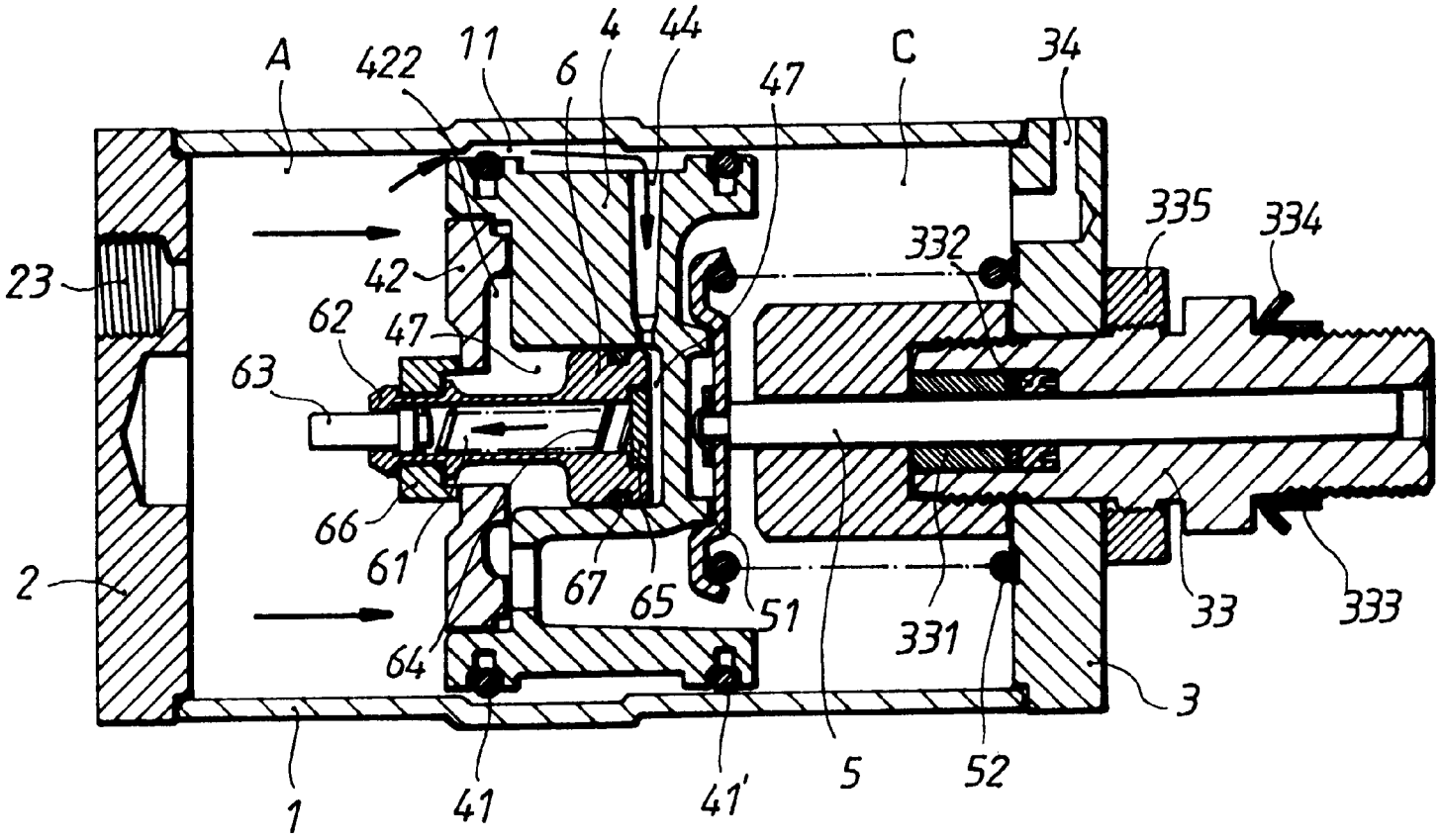
FIG. 3 is a cross-sectional view of the motor showing the external air path as it enters the cylinder to push the pneumatic piston according to the present invention.
Figure 4:
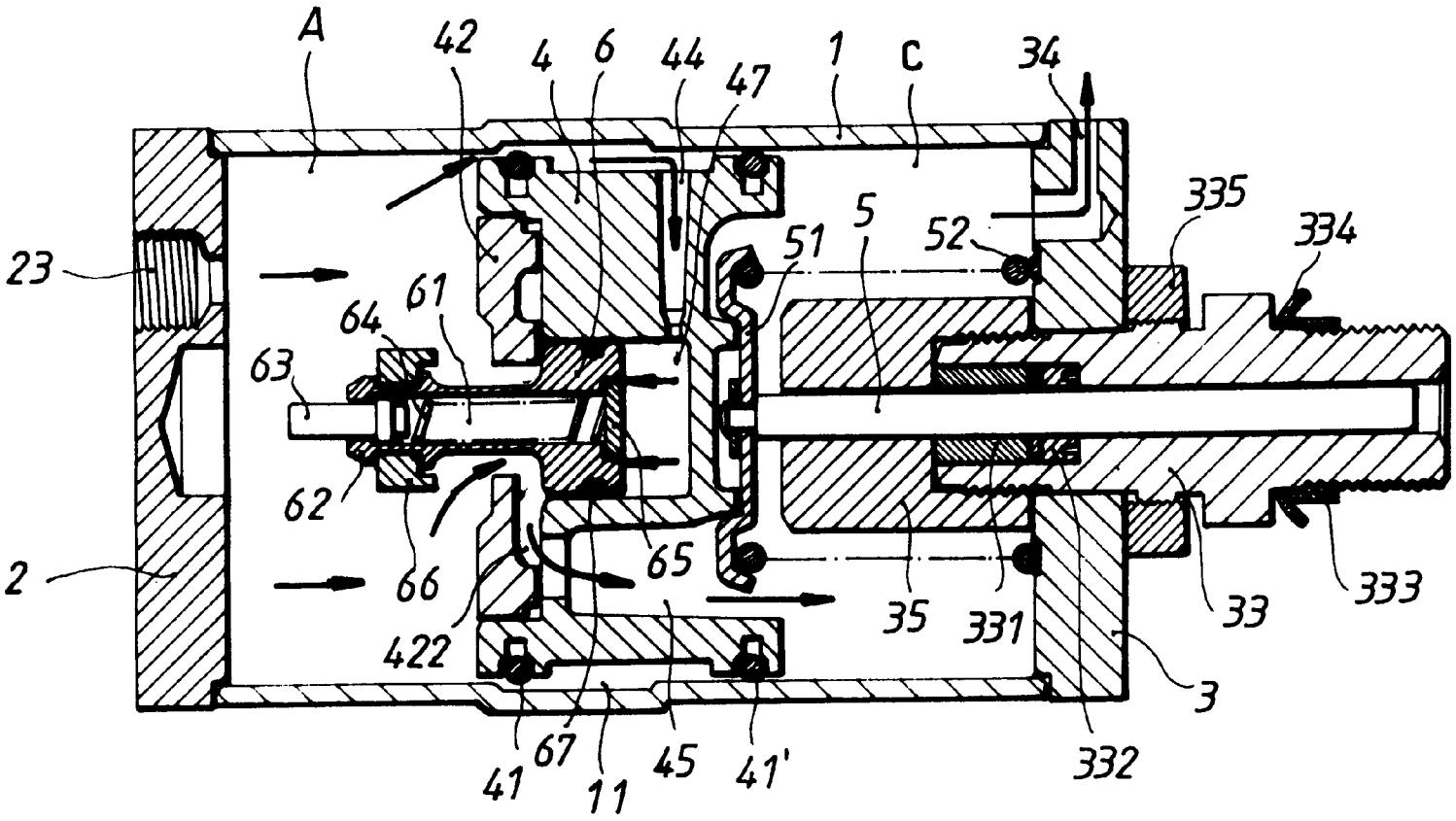
FIG. 4 is a cross-sectional view of the motor showing the shuttle valve in an open position according to the present invention.
Figure 5:
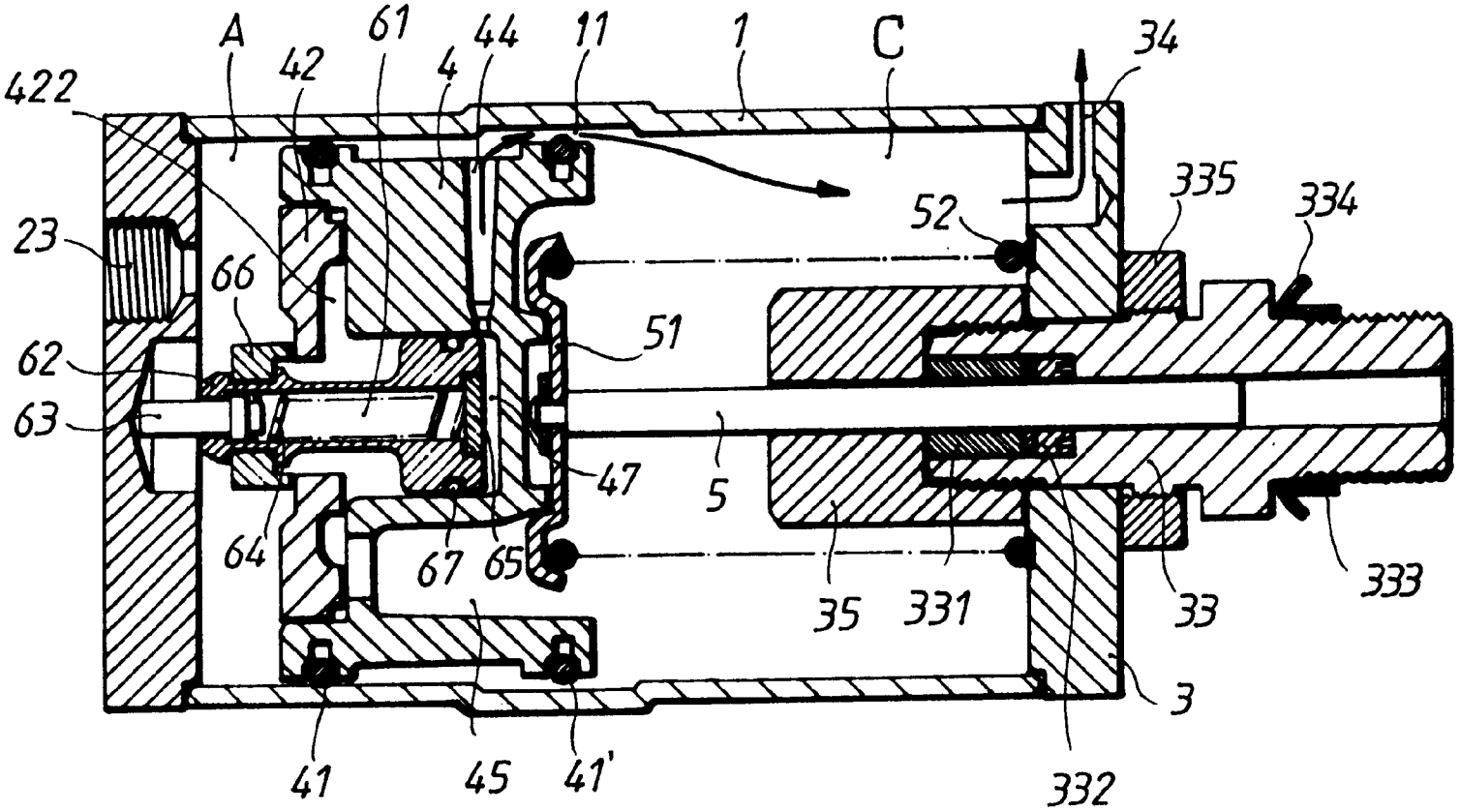
FIG. 5 is a cross-sectional view of the motor showing the shuttle valve in a closed position at the air of the first cycle of the operation according to the present invention.
Figure 6:
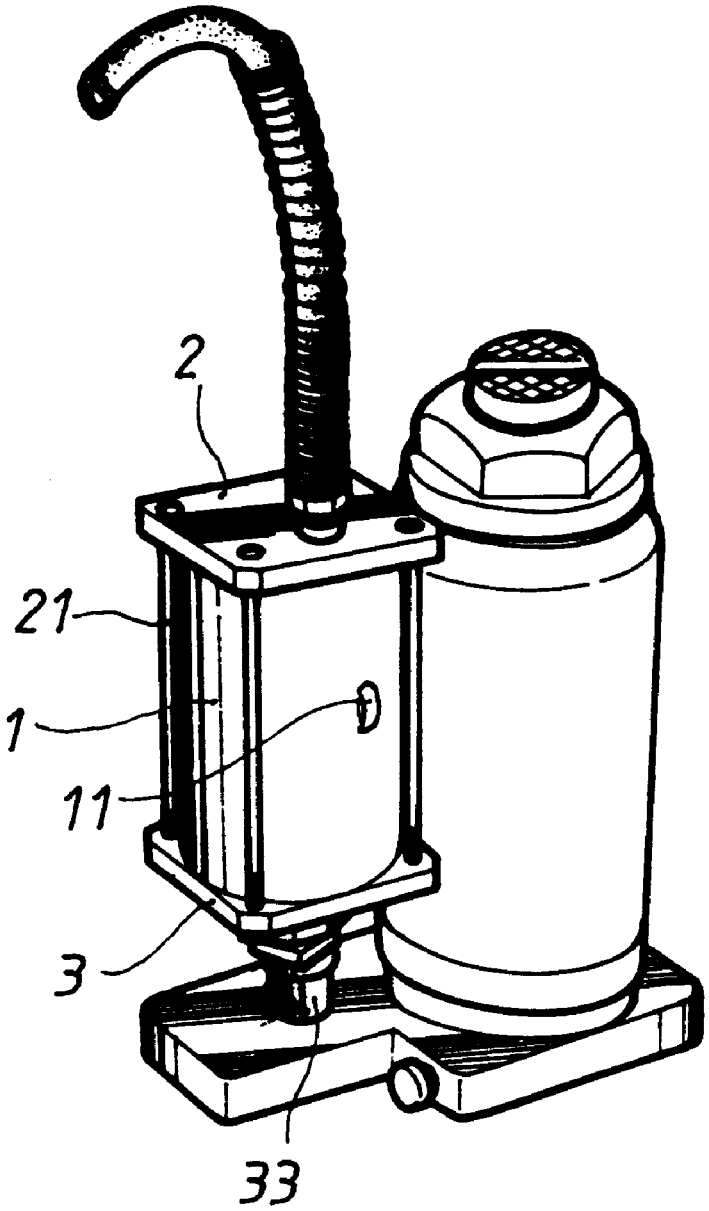
FIG. 6 is a perspective view of a hydraulic jack with the reciprocating pneumatic motor according to the present invention.

Referring to FIGS. 2 and 3, compressed air entering from the air inlet hole 23 of the cylinder cover 2 pushes the pneumatic piston 4 forwards. When the first seal ring 41 passes the guided grooves 11, a gap is formed. This gap allows the air to pass through the radial air inlet hole 44 and into the shuttle compression chamber 47, as shown in the direction of the arrow in FIG. 3. Since the bottom surface area of the shuttle valve 46 is larger than its top surface area, therefore, under the same force condition, the pressure exerted on the bottom surface area is higher than of the top surface area. This higher pressure can push the shuttle valve 6 forward and open up the air vented hole 45. At the same time, an air gap is formed (as shown in FIG. 4) between the shuttle valve 6 and the ring plate 42 which allows air to pass through to the air vented hole 45 and rapidly vent through the L-shaped holes 34 to the outside. The venting lowers the pressure to a point that the tension of the coiled spring 52 pushes the piston rod 5 backward to its original state. The remaining air in the shuttle compression chamber 47 passes through the gap between the second seal ring 41' and the guided grooves 11 and is vented out through the L-shaped holes 34, as shown in FIG. 5. When the air in the shuttle compression chamber 47 is completely vented, the shuttle valve 46 shuts off automatically and returns to its original state, as shown in FIG. 2. The compressed air going in and the venting are happening instantaneously, therefore the piston rod 5 begins reciprocating.

As indicated above, the shuttle valve 6 has the press rod 63 and the compression spring 64 in it. The press rod 63 is used to press against the cylinder cover 2, enabling the shuttle valve 6 to shut off automatically at an early stage, so as to shorten the stroke of the pneumatic piston 4. When the pneumatic piston 4 bears the load, the front air chamber, referenced by A, has a relatively higher pressure, which passes the guide grooves 11 to push open the shuttle valve 6, and is then accumulated in the shuttle compression chamber 47 after the shuttle valve 6 has been opened. When the pneumatic piston 4 moves to the guide grooves 11 (see FIG. 3), the shuttle valve 6 starts to shut off, and air must be carried away from the shuttle compression chamber 47. Because the L-shaped holes 34 are throttled at this stage, high pressure air which comes from the front air chamber A is not completely exhausted, much pressure is needed to close the shuttle valve 6, thereby causing the compression stroke of the compression spring 64 as well as the stroke of the pneumatic piston 4 to be relatively increased.

As indicated above, the stroke of the pneumatic piston 4 is relatively increased and its speed is relatively slowed down when bearing the load. On the contrary, when the pneumatic piston 4 bears no load, its stroke is relatively shortened, and its speed is relatively accelerated.

What the invention claimed is:

1. A shuttle valve mounted between a pneumatic piston and a ring plate in a reciprocating pneumatic motor and moved to control a passage between a front air chamber and an air vent hole in the pneumatic piston, the shuttle valve comprising a valve body having a longitudinal center through hole and an inside annular flange at one end of said longitudinal center through hole, an end cap fixedly fastened to another end of said longitudinal center through hole on said valve body remote from said inside annular flange, a compression spring mounted inside said longitudinal center through hole and supported on said end cap, a press rod supported on said compression spring inside said longitudinal center through hole, said press rod having a front end extending out of said valve body and an outward flange raised around a rear end thereof and supported on said compression spring, the outward flange of said press rod being stopped by said inside annular flange from passing out of said valve body, a gasket ring and an oil seal ring respectively mounted around said valve body on the outside near two opposite ends thereof.

* * * * *